United States Patent [19]

Fischer

[11] Patent Number: 4,577,558

[45] Date of Patent: Mar. 25, 1986

[54] INK METERING APPARATUS FOR A PRINTING MACHINE

[75] Inventor: Hermann Fischer, Augsburg, Fed. Rep. of Germany

[73] Assignee: M.A.N. Roland Druckmaschinen Aktiengesellschaft, Offenbach am Main, Fed. Rep. of Germany

[21] Appl. No.: 676,783

[22] Filed: Nov. 30, 1984

[30] Foreign Application Priority Data

Dec. 10, 1983 [DE] Fed. Rep. of Germany ..... 3344776

[51] Int. Cl.[4] ..... B41F 31/26

[52] U.S. Cl. ..... 101/365; 101/350

[58] Field of Search ..... 101/349, 350, 351, 352, 101/365

[56] References Cited

U.S. PATENT DOCUMENTS

| | | | |
|---|---|---|---|
| 1,737,628 | 12/1929 | Wood | 101/351 X |
| 3,063,369 | 11/1962 | Timson | 101/351 X |
| 3,688,694 | 9/1972 | Preuss et al. | 101/350 X |
| 3,926,116 | 12/1975 | Wildeman | 101/352 X |
| 4,148,256 | 4/1979 | Fischer | 101/350 |
| 4,481,882 | 11/1984 | Rudolph | 101/352 X |

FOREIGN PATENT DOCUMENTS

| | | | |
|---|---|---|---|
| 1129446 | 5/1962 | Fed. Rep. of Germany | 101/352 |
| 2924635 | 1/1981 | Fed. Rep. of Germany | 101/350 |
| 2516863 | 5/1983 | France | 101/350 |
| 104259 | 5/1973 | German Democratic Rep. | . |

*Primary Examiner*—Edgar S. Burr
*Assistant Examiner*—John A. Weresh
*Attorney, Agent, or Firm*—Frishauf, Holtz, Goodman & Woodward

[57] ABSTRACT

Individual ink disk or roller elements (4) are located, axially positioned next to each other on a roller transfer structure; to provide for smooth operation of the ink train rollers, the disks or roller elements of the ink roller structure are in continuous surface engagement with an ink-receiving roller (5) forming part of the roller train, and driven at machine speed, and selectively shiftable about its circumference, by deflection of individual angled levers (6) for selective engagement with a ductor roller of an ink supply, leaving, however, a gap or nip (x) for ink transfer from the ductor roller. The stroke of the deflection of the individual angled levers is adjustable by adjustable stop elements (7; 12, 13, 17', 22) to control the width of the gap or nip between the ink disks or roller elements (4) and the ductor roller, when the disks or roller elements are moved toward the ductor roller.

20 Claims, 7 Drawing Figures

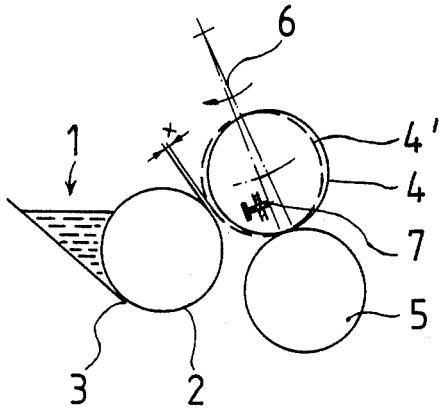
FIG.1
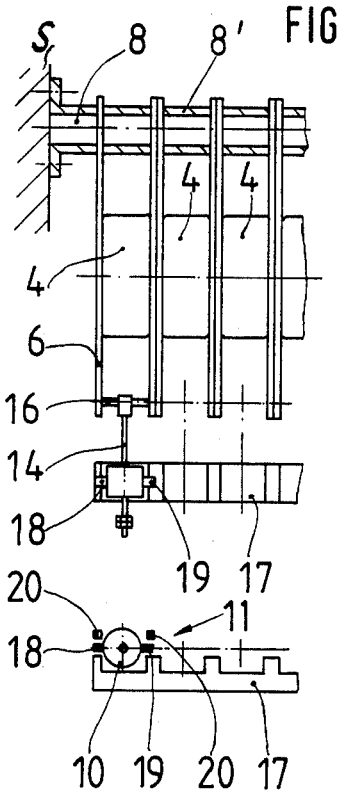
FIG.2
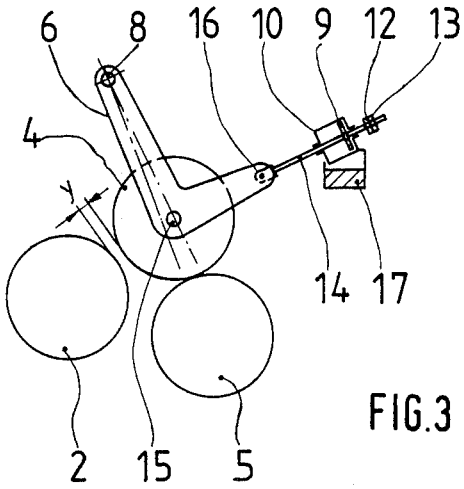
FIG.3
FIG.4

INK METERING APPARATUS FOR A PRINTING MACHINE

Reference to related applications, assigned to the assignee of the present invention, the disclosure of which is hereby incorporated by reference: U.S. Ser. No. 676,784, filed Nov. 30, 1984, FISCHER (priority Fed. Rep. Germany Appln. No. P 33 44 778.0 of Dec. 10, 1983); U.S. Ser. No. 676,781, filed Nov. 30, 1984 FISCHER (priority Fed. Rep. Germany Appln. No. P 33 44 777.2 of Dec. 10, 1983). Related patent: German Democratic Republic Patent DD-PS No. 104 259.

The present invention relates to printing machines, and more particularly to an ink application and metering apparatus, in which an ink transfer roller structure having a plurality of axially spaced disks is used to transfer ink from a metered layer on an ink transfer roller to an ink receiving roller in an ink roller train of the printing machine. The apparatus is particularly suitable for rotary offset printing machines.

BACKGROUND

It has previously been proposed—see German Democratic Republic Pat. No. 104 259—to provide an ink roller train in which a metering roller is included which is constructed as a plurality of axially spaced disks. The disks are, selectively, engaged with an ink supply roller and an ink receiving roller. It has been found that the arrangement there disclosed has a disadvantage, namely that the disks, during their engagement with the ink ink supply roller, are not available for milling of the ink film on the downstream ink-receiving roller and, further, that, upon selective engagement, cyclic acceleration and braking of the rollers occurs which, in addition to the shocks of impingement as the disks impinge on the ink-receiving roller, cause disturbances within the ink train and, specifically, within the drive gearing of the rollers of the ink train. These disturbances can be transferred to the printing cylinders, for example to the plate cylinder, and detrimentally affect the eventual printing result due to interference with continuous and desired supply of ink.

THE INVENTION

It is an object to utilize the advantages of an inking systems which includes disk-type ink rollers, without, however, being subjected to the disadvantages above referred to.

Briefly, in accordance with the invention, the roller transfer structure which is formed by a plurality of rotatable axially spaced disks or stub roller elements is movably positioned in the roller train, and so located therein that it is in continuous surface engagement with the ink-receiving roller, that is, the roller downstream—in the direction of ink transfer—of the transfer roller structure with the spaced disks. Movement, thus, is essentially in a path about the circumference of the ink-receiving roller, so that no shocks or impingement vibrations are transferred thereto upon engagement of the respective disks or roller elements with an ink supply roller; likewise, the continuous engagement permits milling, shearing, distributing, and splitting of the ink layer on the ink-receiving roller. No acceleration or braking effects will be transferred to the ink-receiving roller, since the respective disks of the transfer structure continuously rotate at the circumferential speed of the ink-receiving roller.

The moving distance about the ink-receiving roller is limited, for example by stops controlling operating elements which control movement about the ink-receiving roller of the axially spaced disks or stub roller elements. The ink is supplied to the disks or stub roller elements directly, for example, from a ductor roller which forms the ink supply roller to the structure. The stops determine, also, a remaining gap or nip, which is adjustable, between the respective disks or roller elements and the ductor roller.

The movement, that is, ink transfer, by the respective disks or roller elements, is individually controllable, so that the axial distribution of ink transfer can be controlled without controlling the ink pick-up by a ductor roller, for example by adjustment of a doctor blade. Further, metering of ink, in axial direction with respect to the inkers, is readily possible although the ductor roller may operate at a speed which is slow with respect to machine speed, corresponding, essentially, to the circumferential speed of the plate cylinder. Since the spaced disks or roller elements are in continuous surface engagement with the ink-receiving roller, which may be axially oscillating or reciprocating, they are available for continuous milling, shearing, distributing, and splitting of the ink layer on the ink-receiving roller.

The arrangement has the additional advantage that the ink transfer structure can be readily added to conventional, already constructed inkers, without substantial change or modification of the overall roller arrangement, or its placement in the overall inker structure.

DRAWINGS

FIG. 1 is a schematic side view of a printing machine having an ink train which, generally, can be conventional, modified, however, by the structure in accordance with the present invention;

FIG. 2 is a fragmentary side view showing pneumatic control for respective ink disks;

FIG. 3 is a schematic side view illustrating the operation of the pneumatic control;

FIG. 4 is a fragmentary schematic view illustrating the bearing arrangement for a plurality of pneumatic control units;

DETAILED DESCRIPTION

Figure 5:
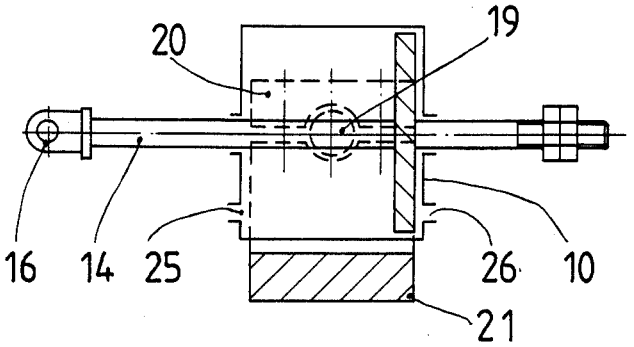
FIG. 5 is a schematic detail view of a bearing arrangement for a pneumatic control element.

An ink trough 1 has an ink ductor roller 2 rotating therein, driven at a speed which is slow with respect to machine speed. A doctor blade 3 applies a metered film of ink on the ductor roller 2.

In accordance with the ink requirement, in respective axial zones, and depending on the subject matter to be printed, a plurality of disks or roller elements 4, which are in continuous surface engagement with a driven ink-receiving roller 5, also termed the first milling roller and, for example, a reciprocating roller, receives ink from the disks or roller elements 4. The ink-receiving roller 5, which is part of an ink roller train—not shown, and which may be entirely conventional—applies ink to a plate cylinder of a printing machine, not further shown.

The disks or roller elements 4 are continuously available for distributing, milling and shearing and splitting of the ink film on the receiving roller 5, and, therefore, are retained in continuous surface engagement with the roller 5.

Figure 7:
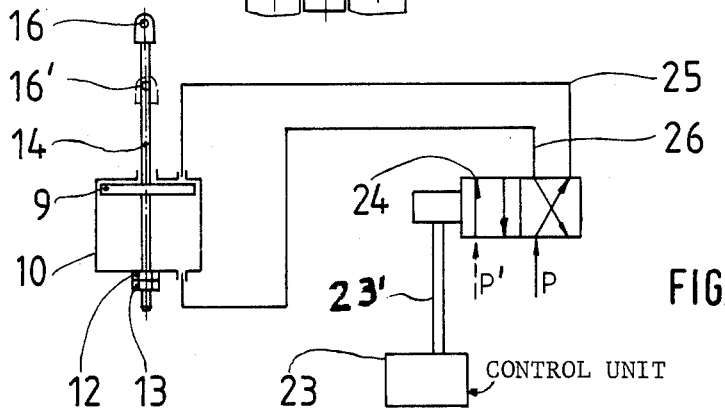
FIG. 7 is a valving and control diagram for pneumatic control of respective disks of the transfer roller structure.

In accordance with a feature of the invention, the disks or roller elements 4 are movable in a path about the circumference of the roller 5 for a distance y—see FIG. 3. Since the ductor roller 2 operates at a substantially slower speed than the receiving roller 5 which, as is customary, operates at machine speed, that is, for example at the circumferential speed of the plate cylinder of the machine, simultaneous engagement of the disks or roller elements 4 with the receiving roller 5 and the ductor roller 2 is prevented by limiting the length of movement in the direction of the path y. This movement is limited by a stop element 7—see FIG. 1—which is so adjusted that ink can be transferred from the ductor roller 2 to the ink metering disks or roller elements 4 while retaining a gap or nip x between the elements 4 and the ductor roller 2—see FIG. 1. The ink gap or nip permits bridging of the speed differential between the ductor roller 2 and the ink-receiving roller 5, which is driven at machine speed, and with which the disks or roller elements 4 are in continuous engagement, and hence driven by frictional surface contact also, effectively, at machine speed. The roller 4 is shown at 4' in broken-line position in FIG. 1, moved through the path y, but retaining the nip or gap x from the ductor roller 2. Thus, and as seen in FIG. 1, the roller 4 remains in surface contact with the roller 5, while being moved close enough to the ductor roller 2 to receive a film of ink therefor. The quantity of ink which is required in the respective axial zones can be easily controlled by either changing the time of movement of the respective disks or roller elements 4 to the position 4', or the frequency of movement, so that more, or less, ink, per unit time, which with constant speed corresponds to proportional ink transfer, is transferred to the roller 5. Of course, pulsed movement or rocking of the disks or roller elements 4 about the roller 5 permits intermittent transfer of ink which is then further distributed in a roller train—not shown—and made uniform about the circumferences of the subsequent inking rollers within the roller train. The overall quantity, however, thus can be accurately controlled with uniform distribution about the circumference of the roller 5. Control of movement of the elements 4 about the circumference of the roller 5 to the position 4' will be explained in connection with the control system of FIG. 7. The gap x may, for example, be in the order of 0.05 mm. The length of the path y may, for example, be in the order of several tenths of a millimeter.

The ink metering disk or roller elements 4 are selectively applied by a mechanism shown in greater detail in FIGS. 2–4. As best seen in FIGS. 2 and 3, the elements 4 are located in axial alilgnment, adjacent each other, but separated from each other by spacing bushings 8', thereby defining the axial zone positions of the disks or roller elements 4. Each roller element or disk 4 is held in position by at least one—preferably two—angled pivot levers 6. Preferably, one pivot lever 6 is located at each end face of an element 4. One end of the pivot lever 6 is pivotably secured on a shaft 8, on which the bushings 8' are located. Shaft 8 is secured to a side wall S of the printing machine. The levers 6 are angled levers—see FIG. 3—and the opposite end thereof is pivotably linked, at 16, to a control apparatus, preferably a cylinder-piston arrangement which may be operated pneumatically, hydraulically, or may be replaced by an electromagnetic structure. In the example selected, the control arrangement is a pneumatically operated piston-cylinder combination, having a piston 9 operable within a cylinder 10. The piston 9 is movable to cover the path or distance y, and is pivotably secured in a bearing 11 (FIG. 4). The stroke of the piston 9 can be adjusted by setting nuts 12, 13 which, for example, can be engaged against the cylinder 10, respectively, or against a fixed abutment 17' of the machine.

The engagement force of the respective disks or roller elements 4 in the directio of the roller 2 will be determined by the air pressure within the cylinder 10. The disks or roller elements 4 are located centrally on the lever 6, rotatable about a pin 15. The piston rod 14 is pivotably connected by a bolt 16 with an end of the lever 6. To engage the respective disks or roller elements 4 in the direction of the ink-receiving roller 5, the levers 6 are preferably located on a shaft 8 by means of eccentric elements.

In accordance with a feature of the invention, continuous contact is maintained between the ink metering disks or roller elements 4 and the ink-receiving roller 5. This contact is maintained even if the circumference of one of the engaging elements, that is, the disks or elements 4 or the roller 5, respectively, becomes worn.

The cylinder 10 is preferably retained to be pivotable within a bearing 11, in order to carry out the movement of the respective disks or roller elements 4 about or around the circumference of the ink-receiving roller 5, in the direction of the ink transfer roller 2 over the path distance y. The cylinder 10, as best seen in FIGS. 4 and 5, has lateral stub shafts 18, 19 secured thereto which, preferably, are journalled in a common comb strip 17. These stubs 18, 19, which form bearing pins, are retained in position and closed off by a bearing cover 20. A common support base 21 is provided to receive the bearing pins 18, 19.

The system is controlled by a control unit 23 which controls the required ink in respective axial zones to be transferred to the receiving roller and hence through the roller train to the plate cylinder 1. The control unit is shown connected only to one cylinder; a plurality of outputs 23' from the control unit will be provided, however, one to each one of the control units 9, 10 for the respective disks or roller elements 4. The control unit may be arranged to provide ink supply, in accordance with preset, manual requirements, as determined by the subject matter to be printed, or can be automatically controlled based on ink requirements, as communicated to the control unit by a sensing structure, well known in the prior art, and determining the respective ink requirement in axial zones, to be transferred to the place cylinder.

Figure 6:
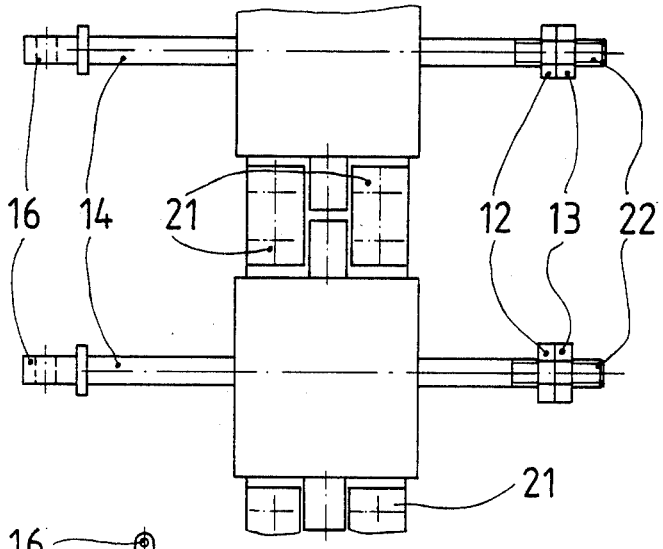
FIG. 6 is a schematic detail view of a bearing arrangement for a plurality of pneumatic control elements.

The control unit 23 has the output 23' connected for a specific piston-cylinder combination in form of an electrical signal applied to a magnetic control valve 24 which receives, for example, compressed air shown schematically by the arrows P, P'. The magnetic control valve 24, selectively, applies compressed air to the output lines 25, 26, in accordance with the output from the control unit, to thereby control movement of the piston 9 within the cylinder 10. For example, if compressed air P' is supplied over line 26, piston rod 14 is projected and the bolt and link 16 will assume the position shown in FIG. 7 in full lines. Upon application of compressed air to line 25, as shown by the arrow P, the piston 9 will be moved downwardly—with respect to FIG. 7—and the piston rod 14 will be retracted, moving the pivot bolt 16 to the broken-line position shown at 16'. The movement is transferred over the lever 6 to the respective disk or roller element 4 which will roll about the circumference of the ink-receiving roller 5 to, selectively, contact the roller 3, or leave the space y therefrom. The two positions of the roller elements or disks 4 of the structure 4' are shown in FIG. 1, in, respectively, full-line and broken-line position. It should be noted that in both positions, the roller elements 4 are in contact with the ink-receiving roller 5. The adjustment nuts 12, 13 are threaded on an end portion of the piston rod 14, as best seen in FIG. 6, for appropriate adjustment against, for example, the abutment 17'.

Various changes and modifications may be made within the scope of the invention concept.

I claim:

1. Ink application and metering apparatus for a printing machine, particularly rotary offset printing machine, having a plate cylinder (1) being driven at a predetermined circumferential machine speed;

a ductor roller (2) carrying a film of ink of predetermined and controlled thickness, and driven at a speed which is slow with respect to machine speed;

an ink receiving roller (5);

an ink transfer roller structure (4'), having a plurality of rotatable, axially spaced roller elements (4), and comprising means (6) for movably supporting said spaced roller elements (4) for selectively establishing a controlled continuous serial linear ink transfer path from the ink ductor roller (2) to the ink-receiving roller (5) or, selectively, interrupting said continuous transfer path via said spaced roller elements, wherein, the ink-receiving roller (5) is driven to operate at machine speed;

the support means (6) individually support the individual roller elements (4) in continuous surface engagement with the ink-receiving roller (5), means for mounting said support means for individual movement of selected roller elements about an axis located on the opposite side of said roller elements from said ink-receiving roller, said mounting means including means to maintain engagement of said ink-receiving roller and said roller elements as said support means is moved about said axis for individual selective movement of said roller elements through a movement path (y) towards said ductor roller (2) through a limited extent up to a predetermined gap or nip (x) from the surface of the ductor roller in which the respective roller elements can receive ink from an ink film on the ductor roller in accordance with the width of said gap or nip;

and adjustable stop means (17; 12, 13, 22) are provided adjusting the width of the gap or nip between the respective individual roller elements (4) and the ductor roller (2) when moved towards the ductor roller by said support means.

2. Apparatus according to claim 1, wherein said support means comprises a plurality of angled levers (6) associated with respective roller elements (4), each angled lever having one end pivoted about a fixed shaft (8);

and operating elements (9, 10, 14) coupled to the other ends of the angled levers.

3. Apparatus according to claim 2, including a pair of bearing pins (18, 19) pivotably retaining the operating elements in position in the printing machine;

the operating elements being pivotably secured to the respective angled levers at approximately the apex of the angled levers, pivotable movement of the operating element permitting at least approximately circular displacement of the roller elements (4) along the circumference of the ink-receiving roller (5).

4. Apparatus according to claim 2, wherein at least one angled lever (6) is provided for each roller element 4;

and wherein individual elements (9, 10, 14) are operatively associated with selected roller elements (4) and connected to at least one of the angled levers (6) supporting respective roller elements (4).

5. Apparatus according to claim 3, wherein at least one angled lever (6) is provided for each roller element (4);

and a common support strip (17) is provided retaining said bearing pins in position in the machine.

6. Apparatus according to claim 2, wherein the operating elements comprise cylinder-piston units.

7. Apparatus according to claim 6, wherein the cylinder-piston units comprise a fluid operated cylinder-piston units;

and a magnetic control valve means (24) is provided, controlling respective fluid operated cylinder-piston units.

8. Apparatus according to claim 6, wherein at least one individual angled lever (6) is provided for operatively movably retaining an individual roller element (4) in position against the ink-receiving roller (5), and, selectively, is movable toward said ductor roller (2);

and wherein individual control elements (24) are provided for controlling the respective operating elements (9, 10, 14).

9. Apparatus according to claim 8, wherein the operating elements are pneumatic cylinder-piston units;

and individual control means are provided; which comprise magnetic control valves.

10. Apparatus according to claim 3, wherein the angled levers are eccentrically rotatable about the shaft (8).

11. Apparatus according to claim 4, wherein the angled levers are eccentrically rotatable about the shaft (8).

12. Apparatus according to claim 5, wherein the angled levers are eccentrically rotatable about the shaft (8).

13. Apparatus according to claim 1, wherein the stroke or distance of movement over which said support means move said roller elements (4) is adjustable by said adjustable stop means (17', 12, 13, 22).

14. Apparatus according to claim 1, wherein the movable support means include coupling rods (14), and the adjustable stop means include adjustment nuts (12, 13) threaded on the coupling rods and engageable against a fixed stop means (10, 17).

15. Apparatus according to claim 6, wherein each cylinder-piston unit includes a piston rod (14) and the stop means includes adjustment nuts (12, 13) threaded on the piston rods and engageable against a fixed stop means (10, 17).

16. Apparatus according to claim 7, wherein each cylinder-piston unit includes a piston rod (14) and the stop means includes adjustment nuts (12, 13) threaded on the piston rods and engageable against a fixed stop means (10, 17).

17. Apparatus according to claim 9, wherein such cylinder-piston unit includes a piston rod (14) and the stop means includes adjustament nuts (12, 13) threaded on the piston rods and engageable against a fixed stop means (10, 17).

18. Apparatus according to claim 1, wherein the ink-receiving roller (5) is an axially reciprocating or ink milling roller.

19. Apparatus according to claim 2, wherein the ink-receiving roller (5) is an axially reciprocating or ink milling roller.

20. Apparatus according to claim 16, wherein the ink-receiving roller (5) is an axially reciprocating or ink milling roller.

* * * * *